United States Patent [19]

Kodama

[11] 4,403,930

[45] Sep. 13, 1983

[54] MULTI-PIECE APEX SEAL STRUCTURE FOR A ROTARY PISTON ENGINE

[75] Inventor: Hiroshi Kodama, Hiroshima, Japan

[73] Assignee: Toyo Kogyo Co., Ltd., Hiroshima, Japan

[21] Appl. No.: 183,043

[22] Filed: Sep. 2, 1980

[30] Foreign Application Priority Data

Sep. 3, 1979 [JP] Japan ..... 54-122199[U]

[51] Int. Cl.[3] ..... F01C 19/04

[52] U.S. Cl. ..... 418/121; 418/123

[58] Field of Search ..... 418/113, 120–124

[56] References Cited

U.S. PATENT DOCUMENTS

| | | | |
|---|---|---|---|
| 3,120,815 | 2/1964 | Froede | 418/123 |
| 3,176,909 | 4/1965 | Maurhoff | 418/121 |
| 3,685,922 | 8/1972 | Lamm | 418/121 |

*Primary Examiner*—John J. Vrablik

*Attorney, Agent, or Firm*—Fleit & Jacobson

[57] ABSTRACT

An apex seal structure of two-piece construction including a main or sealing piece and an under or support piece which are disposed in a sealing groove in a rotor apex portion with a superposed relationship with each other. The main piece has a bottom surface which is in engagement with the top surface of the under piece, the bottom surface of the main piece being perpendicular to the side surfaces thereof, and the top surface of the under piece to the side surfaces thereof. In order to prevent inclination of the main piece in the sealing groove, the gap between the main piece and the sealing groove is decreased. For the purpose of avoiding any delay of induction of gas pressure behind the pieces, the width of the under piece is decreased with respect to that of the main piece so that an adequate gap is provided between the under piece and the sealing groove.

8 Claims, 7 Drawing Figures

MULTI-PIECE APEX SEAL STRUCTURE FOR A ROTARY PISTON ENGINE

The present invention relates to rotary piston engines and more particularly to apex seal means therefor.

Conventionally, a rotary piston engine includes a casing which comprises a rotor housing having a trochoidal inner wall and a pair of side housings attached to the opposite sides of the rotor housing, and a substantially polygonal rotor disposed in the casing for rotation with apex portions in sliding contact with the inner wall of the rotor housing to define working chambers of cyclically variable volume. In order to provide a gas seal between each two adjacent working chambers, the rotor is provided at each apex portion with an apex seal assembly which is adapted to slide along the inner wall of the rotor housing.

For the purpose, the rotor is formed with a seal groove extending axially along each apex portion and the apex seal assembly is received in the seal groove. In this type of seal structure, it is required that apex seal members provide primary seals with the inner wall of the rotor housing and secondary seals with seal grooves. In order to provide a uniform sliding contact between the seal assembly and the inner wall of the rotor housing, it has been proposed by Japanese patent publication 47-34410 to constitute the apex seal by an upper main piece and a lower piece which are superposed in the sealing groove in such a manner that the main piece slidably engages the inner wall of the rotor housing and the lower piece extends substantially along the bottom of the sealing groove. A spring is provided between the bottom of the sealing groove and the lower piece to force the seal assembly against the inner wall of the rotor housing.

The two-piece type seal structure is considered advantageous in that the main piece is of a small rigidity so that the main piece can flexibly follow any thermal or other deformations of the inner wall of the rotor housing which may often be produced in operation of the rotary piston engine. Thus, it is possible to provide an improved primary seal between the apex seal assembly and the inner wall of the rotor housing. Since the main piece is uniformly engaged with the inner wall of the rotor housing without any uneven local pressure, it is also possible to decrease any possible wear of the main piece to a substantial extent.

It should however be pointed out that, in the two-piece type apex seal structure, the main piece is of a relatively small heightwise dimension so that the main piece may be inclined in the seal groove under the force applied thereto by the inner wall of the rotor housing. This will cause an uneven wear of the main piece in an area which is supposed to contact with the outer edge portion of the seal groove under a normal position so that the secondary seal with the sealing groove will significantly be weakened at this area. Further, the inclination of the main piece destroys the gas tight seal between the main piece and the under piece.

In order to deal with the above problem, the width of the sealing groove may be decreased to such an extent that the aforementioned inclination of the main piece can essentially be prevented. However, such a structure provides a further problem due to a decrease in clearance between the main piece and the sealing groove wall. The apex seal structure is so designed that a gas pressure introduced into the sealing groove forces the sealing member against the inner wall of the rotor housing to maintain a sealing contact therebetween. Where the clearance between the main piece and the sealing groove wall is decreased as described above, however, the passage for leading the gas to the sealing groove is correspondingly decreased so that there will be a delay in building up of the gas pressure in the sealing groove to thereby weaken the primary seal between the main piece and the inner wall of the rotor housing as well as the contact between the main and under pieces.

In the U.S. Pat. No. 3,120,815 issued on Feb. 11, 1964 to Waiter G. Froede there is proposed to provide an apex seal including an elongated sealing piece which is formed at radially inward end that is facing to the bottom of the sealing groove with a sidewardly inclined surface. A spring or an insert member having a corresponding inclined surface is forced into engagement with the sealing piece so that the sealing piece is sidewardly forced under the action of the mutually engaging inclined surfaces into engagement with the side wall of the sealing groove. However, this type of apex seal structure is inconvenient in manufacture and disadvantageous in that the main and under pieces are sidewardly forced to contact with the side walls of the sealing groove so that a sufficient gas pressure cannot be introduced behind the apex seal assembly.

It is therefore an object of the present invention to provide an apex seal structure of two-piece construction in which the aforementioned inclination of the main piece can be prevented without producing any delay of induction of gas pressure into the seal groove.

Another object of the present invention is to provide an apex seal structure of two-piece construction in which the height of the main piece is so determined that the aforementioned inclination thereof can be effectively prevented.

According to the present invention, the above and other objects can be accomplished by a rotary piston engine including a casing which comprises a rotor housing having an inner wall of trochoidal configuration and a pair of side housings attached to the opposite sides of the rotor housing, and a substantially polygonal rotor disposed in the casing with apex portions in sliding engagement with the inner wall of the rotor housing, said rotor having an apex seal structure in each apex portion thereof, said apex seal structure including an apex seal groove having side and bottom walls and formed along each apex portion, an apex seal assembly disposed in said seal groove and comprised of a main piece adapted to be engaged with said inner wall of the rotor housing and an under piece located beneath the main piece, resilient means for urging the main and under piece toward the inner wall of the rotor housing, said main piece having a pair of side surfaces, a bottom surface which is substantially perpendicular to the side surfaces and a top sealing surface which is adapted to be brought into sliding engagement with the inner wall of the rotor housing, said under piece having a pair of side surfaces and a top surface which is substantially perpendicular to the side surfaces and adapted to be engaged with the bottom surface of the main piece, said main piece having a width between the side surfaces which is greater than that of the under piece. Preferably, the main piece has a height which is greater than that of the under piece and which is so determined that a reaction force applied to the main piece from the inner wall of the rotor housing is directed to intersect one of the side surfaces thereof in a position where a heightwise center line of the main piece is at a maximum angle with respect to a normal line on the inner wall of the rotor housing at a point where the main piece engages the inner wall of the rotor housing. According to the widthwise dimensions of the main and side pieces, it becomes possible to decrease the clearance between the main piece and the side wall of the seal groove without having any adverse influence on the induction of the gas pressure into the seal groove because the width of the under piece can be decreased to thereby increase the clearance between the under piece and the side wall of the seal groove. Thus, the clearance between the main piece and the side wall of the seal groove can be decreased to such an extent that the inclination of the main piece can effectively be prevented. The heightwise dimension of the main piece has also been found to have some importance in preventing inclination of the main piece under the reaction force applied thereto by the inner wall of the rotor housing.

The above and other objects and features of the present invention will become apparent from the following descriptions of preferred embodiments taking reference to the accompanying drawings, in which.

Figure 2:
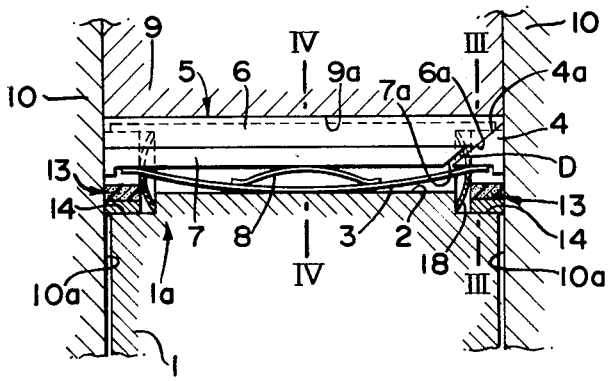
FIG. 2 shows a longitudinal section of an apex seal structure in accordance with one embodiment of the present invention.
Figure 5:
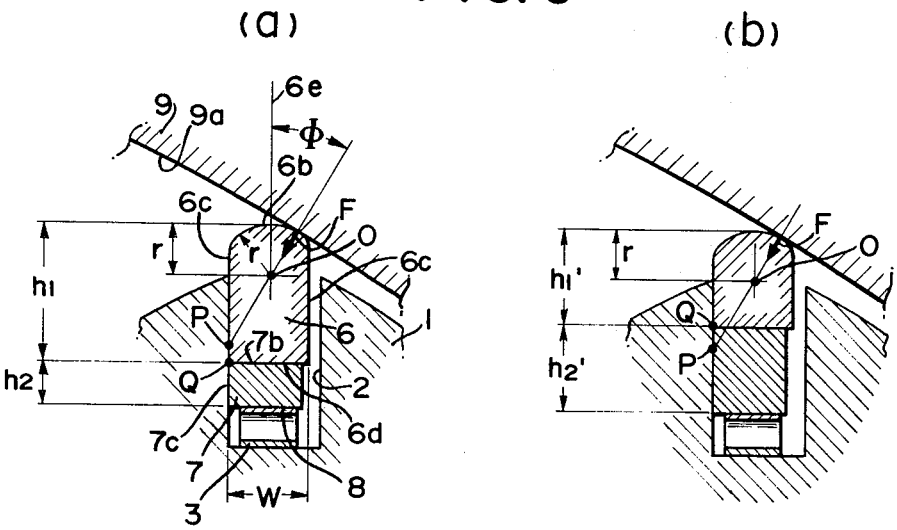
Figure 6:
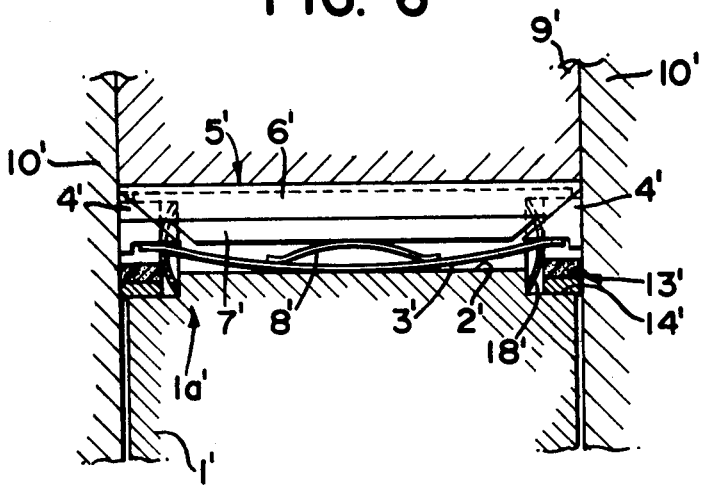

FIGS. 5(*a*) and (*b*) show the direction of reaction force applied to the main piece from the rotor housing; and FIG. 6 shows a modification of the seal structure of FIG. 2.

Figure 1:
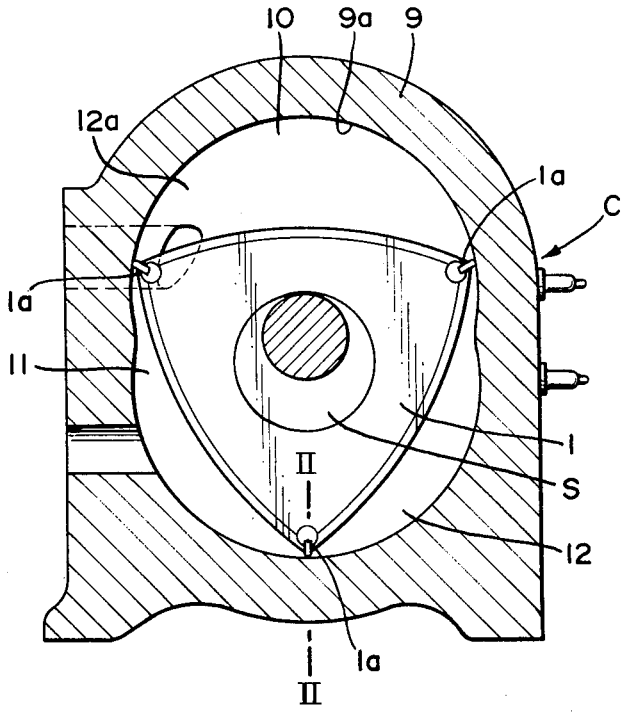
FIG. 1 is a cross-sectional view of a rotary piston engine having apex seal structures to which the present invention can be applied.

Referring now to the drawings, particularly to FIG. 1, the rotary piston engine shown therein includes a casing C comprised of a rotor housing 9 having an inner wall 9*a* of trochoidal configuration and a pair of side housings 10 having inner surfaces 10*a* and secured to the opposite sides of the rotor housing 9. In the casing C, there is disposed a rotor 1 of substantially triangular configuration which is carried by an eccentric shaft S for rotation with apex portions 1*a* in sliding contact with the inner wall 9*a* of the rotor housing 9 to define working chambers 11, 12 and 12*a*.

Referring now to FIG. 2, in each apex portion 1*a*, the rotor 1 is formed with an axially extending sealing groove 2 for receiving an apex seal 5 therein. The apex seal 5 comprises a side piece 4, an elongated sealing or main piece 6 and an elongated support or under piece 7. The sealing and support pieces 6 and 7 are disposed along the sealing groove 2 with a superposed relationship. The side piece 4 has an inclined inward surface 4*a* and the sealing and support pieces 6 and 7 have correspondingly inclined end surfaces 6*a* and 7*a*, respectively. A main leaf spring 3 is provided in the groove 2 with its opposite ends in engagement respectively with the support piece 7 and the side piece 4. Further, an auxiliary spring 8 is provided between the main spring 3 and the support piece 7. Thus, the pieces 4, 6 and 7 are resiliently forced toward the inner wall 9*a* of the rotor housing 9. Since the side piece 4 is in engagement at the inward face 4*a* with the end surface 6*a* of the sealing piece 6, the wedging action produced therebetween functions to force the side piece 4 into engagement with the inner wall 10*a* of one of the side housing 10 and the sealing piece 6 toward the inner wall 10*a* of the other side housing 10. In order to ensure a positive engagement between the side and sealing pieces 4 and 6, it is preferable to have the end surface 7*a* of the support piece 7 spaced apart from the inward surface 4*a* of the side piece 4 to provide a gap D as shown in FIG. 2. In order to suppress gas leakage through the gap D and prevent the support piece from being inclined in the axial direction, the gap D should preferably be less than 100 microns, preferably 40 microns. The gap may be filled with a soft material such as fluoro-resin, zinc, lead or copper.

Figure 3:
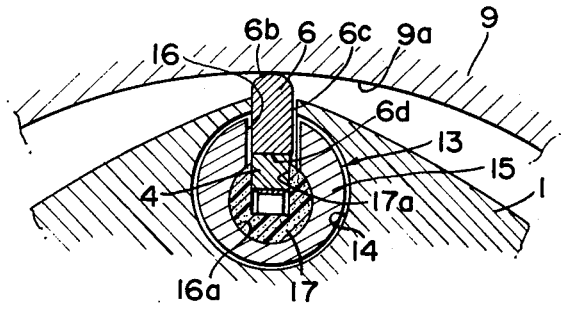
FIG. 3 is a sectional view taken substantially along the line III—III in FIG. 2.

At the opposite ends of the sealing groove 2, the rotor 1 is formed with corner seal recesses 14 for receiving corner seals 13. The corner seal 13 includes a ring-shaped corner seal piece 15 adapted to be fitted to the recess 14. The piece 15 has a radial slit 16 and a circular opening 16*a*, the latter being filled with an insert 17 of a non-rigid material such as fluoro-resin, zinc, lead or copper. The insert 17 has a groove 17*a* in which the bottom portion of the side piece 4 is received as shown in FIG. 3. A leaf spring 18 is provided in the recess 14 for urging the corner seal piece 15 toward the inner wall 10*a* of the side housing 10.

Figure 4:
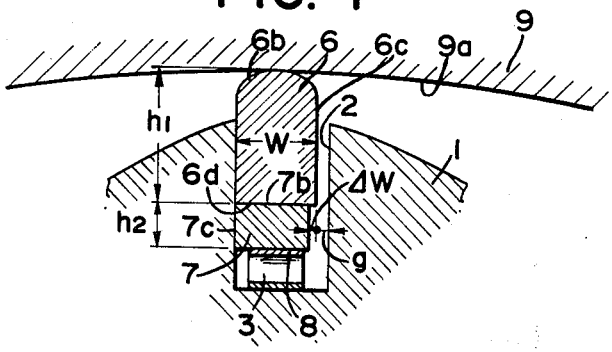
FIG. 4 is a sectional view taken substantially along the line IV—IV in FIG. 2.

As shown in FIGS. 3 and 4, the main or sealing piece 6 has a top surface 6*b* adapted to be engaged with the inner wall 9*a* of the rotor housing 9, a pair of substantially parallel side surfaces 6*c* and a bottom surface 6*d* substantially perpendicular to the side surfaces 6*c*. The support or under piece 7 has a top surface 7*b* and a pair of side surfaces 7*c* which are substantially perpendicular to the top surface 7*b*. The top surface 7*b* of the support piece 7 is in engagement with the bottom surface 6*d* of the sealing or main piece 6. It will be noted in FIGS. 3 and 4 that the main piece 6 has a width w between the side surfaces which is greater than the corresponding width of the under piece 7 as shown by $\Delta w$. It will thus be understood that the clearance or gap g between the side surface 6*c* of the main piece 6 and the opposing side wall of the sealing groove 2 is smaller than the gap between the side surface 7*c* of the under piece 7 and the side wall of the sealing groove 2.

According to the above arrangement, it is possible to decrease the gap g to such an extent that the main piece 6 is prevented from being inclined in the sealing groove 2. Further, since the width of the under piece 7 can be decreased to correspondingly increase the gap between the side surface 7*c* of the under piece 7 and the side wall of the sealing groove 2, it is possible to introduce the gas pressure without delay into the sealing groove 2 so that the main and under pieces 6 and 7 are forced under the gas pressure toward the inner wall 9*a* of the rotor housing 9.

According to a further feature of the illustrated embodiment of FIGS. 2 to 5, the main or sealing piece 6 has a height $h_1$ which is greater than the height $h_2$ of the under or support piece 7. Referring to FIG. 5(*a*), it will be understood that the top surface 6*b* is of a part-circular cross-sectional configuration having a center of circle at a point O and a radius of curvature of r. The top portion of the main piece 6 is projected from the sealing groove 2 by a distance. In this arrangement, the reaction force F as applied to the main piece 6 from the inner wall 9*a* of the rotor housing 9 is directed normal to the top surface 6*b* as well as to the inner wall 9*a* of the rotor housing 9 and passed through the center O of the circle.

As well known in the art, the direction of the vector of the reaction force F is cyclically changed with respect to the heightwise center line 6e of the main piece 6 in accordance with the orientation of the rotor 1. In the embodiment shown in FIG. 5(*a*), the height $h_1$ of the main piece 6 is so determined that, when the rotor 1 is in a position where the angle $\phi$ between the vector of the reaction force F and the heightwise center line 6e of the piece 6 is the largest, an extension of the vector intersects one of the side surfaces 6c of the main piece 6 at a point P. In this arrangement, the reaction force F urges the main piece 6 against the side wall of the sealing groove 2 so that inclination about the point Q of the main piece 6 can effectively be prevented. By the contrary, if the vector of the reaction force F is so directed that an extension thereof be intersected with the bottom surface thereof when the angle $\phi$ is the largest, a moment will be produced about the point Q to turn the main piece 6 clockwise as shown in FIG. 5(*b*). It will thus be understood that the arrangement illustrated in FIG. 5(*a*) is effective in preventing inclination of the main piece 6 in the sealing groove 2.

The apex seal structure in accordance with the present invention is basically constituted as a two-piece construction so that the main or sealing piece has a sufficient flexibility to follow any deformation of the inner wall 9a of the rotor housing 9 which may be produced when the rotor housing 9 is subjected to a high engine operating temperature. Further, it is possible to prevent any inclination of the main piece in the sealing groove to thereby eliminate or suppress uneven wear of the main piece and the inner wall of the rotor housing. In an example, the gap between the main piece 6 and the side wall of the sealing groove 2 may be 50 to 95 microns and the difference in width between the main and under pieces 6 and 7 may be 35 to 45 microns. The height $h_1$ of the main piece 6 may be approximately 5 to 6 mm whereas the height $h_2$ of the under piece 7 may be approximately 2.5 to 3.5 mm, the overall height of the pieces being approximately 8.5 mm. In other words, the main piece 6 is of a height that is 60 to 70% of the overall height whereas the height of the under piece 7 is 40 to 30% of the overall height. The arrangement of the present invention is further advantageous in that the main piece 6 is of a mass which is different from that of the under piece 7 so that the pieces 6 and 7 have different natural frequency to thereby prevent resonant oscillation of the pieces 6 and 7.

In order to maintain a gas tightness between the bottom surface 6d of the main piece 6 and the top surface 7b of the under piece 7, the surfaces must be of a highly precise flatness. Alternatively, a layer of soft material such as fluoro-resin or soft metal may be provided between the surfaces 6d and 7b. Adequate gas tightness can also be maintained by treating the surfaces 6d and 7b by shot blasting so that intimate contact surfaces can be produced in the process of the engine operation.

Referring now to FIG. 6, a modification of the embodiment of FIG. 2 is illustrated. The same reference numerals, with primes attached, have been used to identify components that are the same as those previously described. Attention is directed to the preceding description of Fig. 2 for a description of the components of FIG. 6. It should be noted that the embodiment of FIG. 6 has a side piece 4' provided at opposite longitudinal ends of the main piece 6'.

The invention has thus been shown and described with reference to specific embodiments, however, it should be noted that the invention is in no way limited to the details of the illustrated structures but changes and modifications may be made without departing from the scope of the appended claims.

I claim:

1. Rotary piston engine including a casing which comprises a rotor housing having an inner wall of trochoidal configuration and a pair of side housings attached to the opposite sides of the rotor housing, and a substantially polygonal rotor disposed in the casing with apex portions in sliding engagement with the inner wall of the rotor housing, said rotor having an apex seal structure in each apex portion thereof, said apex seal structure including an apex seal groove having side and bottom walls and a top opening and formed along each apex portion, an apex seal assembly comprised of seal means adapted to be brought into sliding contact with the inner wall of the rotor housing and resilient means for forcing the seal means toward the inner wall of the rotor housing, said apex seal assembly being disposed in said seal groove so that gas pressure is introduced through said top opening to the seal groove to thereby force the seal means toward the inner wall of the rotor housing, said seal means being comprised of a main piece adapted to be engaged with said inner wall of the rotor housing and an under piece located beneath the main piece, said main piece having a pair of side surfaces, a bottom surface which is substantially perpendicular to the side surfaces and a top sealing surface which is adapted to be brought into sliding engagement with the inner wall of the rotor housing, said under piece having a pair of side surfaces and a top surface which is substantially perpendicular to the side surfaces and adapted to be engaged with the bottom surface of the main piece, said main piece having a width between the side surfaces which is greater than that of the under piece.

2. Rotary piston engine in accordance with claim 1 in which the sealing groove has a width which is greater than that of the main piece by 50 to 95 microns, the width of the main piece being greater than that of the under piece by 35 to 45 microns.

3. Rotary piston engine in accordance with claim 1 in which the main piece has a height which is greater than that of the under piece and which is so determined that a reaction force applied to the main piece from the inner wall of the rotor housing is directed to intersect one of the side surfaces thereof in a position where a heightwise center line of the main piece is at a maximum angle with respect to a normal line on the inner wall of the rotor housing at a point where the main piece engages the inner wall of the rotor housing.

4. Rotary piston engine in accordance with claim 2 in which the ratio of the height of the main piece to that of the under piece is 3:2 to 7:3.

5. Rotary piston engine in accordance with claim 1 in which a side piece is provided at a longitudinal end of the main piece.

6. Rotary piston engine in accordance with claim 5 in which a clearance is provided between the longitudinal end of the under piece and the side piece.

7. Rotary piston engine in accordance with claim 1 in which side pieces are provided at opposite longitudinal ends of the main piece.

8. Rotary piston engine in accordance with claim 7 in which a clearance is provided between each longitudinal end of the under piece and the side piece.

* * * * *